United States Patent [19]

Balaguer

[11] 4,055,745

[45] Oct. 25, 1977

[54] FOOD COOKING OVEN

[76] Inventor: Rodolfo Rodriguez Balaguer, 2607 Grace Drive, Harbor Beach, Fort Lauderdale, Fla. 33316

[21] Appl. No.: 678,486

[22] Filed: Apr. 20, 1976

[51] Int. Cl.[2] ..... F27D 11/02

[52] U.S. Cl. ..... 219/406; 13/25; 99/358; 219/385; 219/391; 219/409; 219/521

[58] Field of Search ..... 219/383, 385, 396, 391, 219/402, 406, 407, 408, 409, 521, 543; 99/358; 426/106, 107; 13/25

[56] References Cited

U.S. PATENT DOCUMENTS

| | | | |
|---|---|---|---|
| 2,532,014 | 11/1950 | Davis | 219/383 |
| 2,678,990 | 5/1954 | Quirk | 219/406 |
| 2,809,223 | 10/1957 | Stevenson | 13/25 |
| 3,026,399 | 3/1962 | Lighter | 219/409 X |
| 3,155,758 | 11/1964 | Hill | 13/25 |
| 3,210,199 | 10/1965 | Schlaf | 426/107 |
| 3,296,415 | 1/1967 | Eisler | 219/385 |
| 3,412,234 | 11/1968 | Otavka | 219/406 |
| 3,413,442 | 11/1968 | Buiting et al. | 219/390 |
| 3,771,433 | 11/1973 | King | 99/358 X |
| 3,786,222 | 1/1974 | Harnden, Jr. et al. | 219/10.49 |

*Primary Examiner*—Volodymyr Y. Mayewsky
*Attorney, Agent, or Firm*—Alfred L. Michaelsen

[57] ABSTRACT

A food cooking oven having exterior walls and inwardly spaced interior walls wherein the interior walls are electrically conductive and are connected to an electrical power source. In operation, the interior of the oven is heated to a food cooking temperature by passing an electric current through the interior walls of the oven.

22 Claims, 13 Drawing Figures

FOOD COOKING OVEN

BACKGROUND OF THE INVENTION

Conventional, domestic food cooking ovens are typically heated from a high temperature heat source. For example, in a conventional , domestic gas fired oven, heat is supplied to the oven from a gas flame which is at a temperature substantially higher than 1,000° F. Similarly, conventional, domestic food cooking ovens which are electrically heated include a heating element, such as a calrod unit which is at a temperature well in excess of 1,000° F when an electric current is passed therethrough.

Rather than using a localized, high temperature heat source, a domestic food cooking oven which embodies may invention utilizes the interior walls of the oven as a heat source. As a result, food may be cooked within an oven embodying my invention while maintaining the maximum temperature of the interior walls at a temperature less than a 1,000° F. Although the temperature of the heat source (i.e. the interior walls) in an oven embodying my invention is significantly lower than the temperature of a heat source in a conventional, domestic food cooking oven, nevertheless it has been found that the process of cooking a food in an oven embodying my invention is particularly efficient and, surprisingly, may be significantly faster than cooking processes conducted in conventional food cooking ovens of the type described above.

SUMMARY OF THE INVENTION

An enclosed, substantially self-supporting food cooking oven heating exterior walls and inwardly spaced, electrically conductive interior walls. Preferably, insulation is provided between the interior and exterior walls. Connected to the interior walls is an electrical power source which, when operated, causes an electric current to flow through the interior walls of the oven, thereby heating the interior of the oven to a food cooking temperature, e.g. a temperature in the range of 100 to 500° F.

In accordance with the preferred embodiment of my invention, the interior, electrically conductive walls of the oven are constructed of metal having a thickness in the range of approximately 0.01 to 0.05 inches and the electrical power source is a step down transformer having an output voltage of approximately 1 volt and adapted to provide a current in excess of 100 amperes through the side walls, bottom wall, top wall, and back wall of the oven. If desired, an appropriate temperature sensor may be provided to detect the temperature within the oven and, in response to the detected temperature, the electric current supplied to the oven may be controlled. Alternatively, the aforesaid stepdown transformer may be provided with taps on the primary whereby the voltage impressed across the oven walls may be varied.

In one embodiment of my invention, an oven is provided having exterior walls and inwardly spaced, electrically conductive interior walls which define an interior volume of at least approximately 0.25 cubic feet. In this embodiment, electrical contacts are provided, which extend outwardly beyond the exterior walls of the oven and are electrically connected to the interior walls. When the oven is used, it is placed on top of a power supply unit, which preferably includes a high current, low voltage, step down transformer having a secondary connected to a pair of clamps. The electrical contacts extending from the oven are inserted into the clamps and are clamped therein without the use of any separate tools, for example without the use of a screwdriver, wrench or the like. In this manner, the same power supply unit can be used to perform other functions. Additionally, the oven may conveniently be removed from the power supply unit for cleaning or storage purposes. To facilitate cleaning, the interior walls of the oven are preferably mechanically interconnected to form a water tight enclosure. Thus, the entire oven may be placed within a dishwasher. Cleaning is also facilitated by the fact that there are no separate heating elements inside the oven. Therefore, it is easy to clean the inside of the oven. Additionally, because the oven is powered by a low voltage source, the oven may safely be used after cleaning, even if it is wet.

The two electrical contacts which are connected to the inner walls preferably extend outwardly from the bottom of the oven or from opposite side walls of the oven.

DESCRIPTION OF PREFERRED EMBODIMENTS

Figure 1:
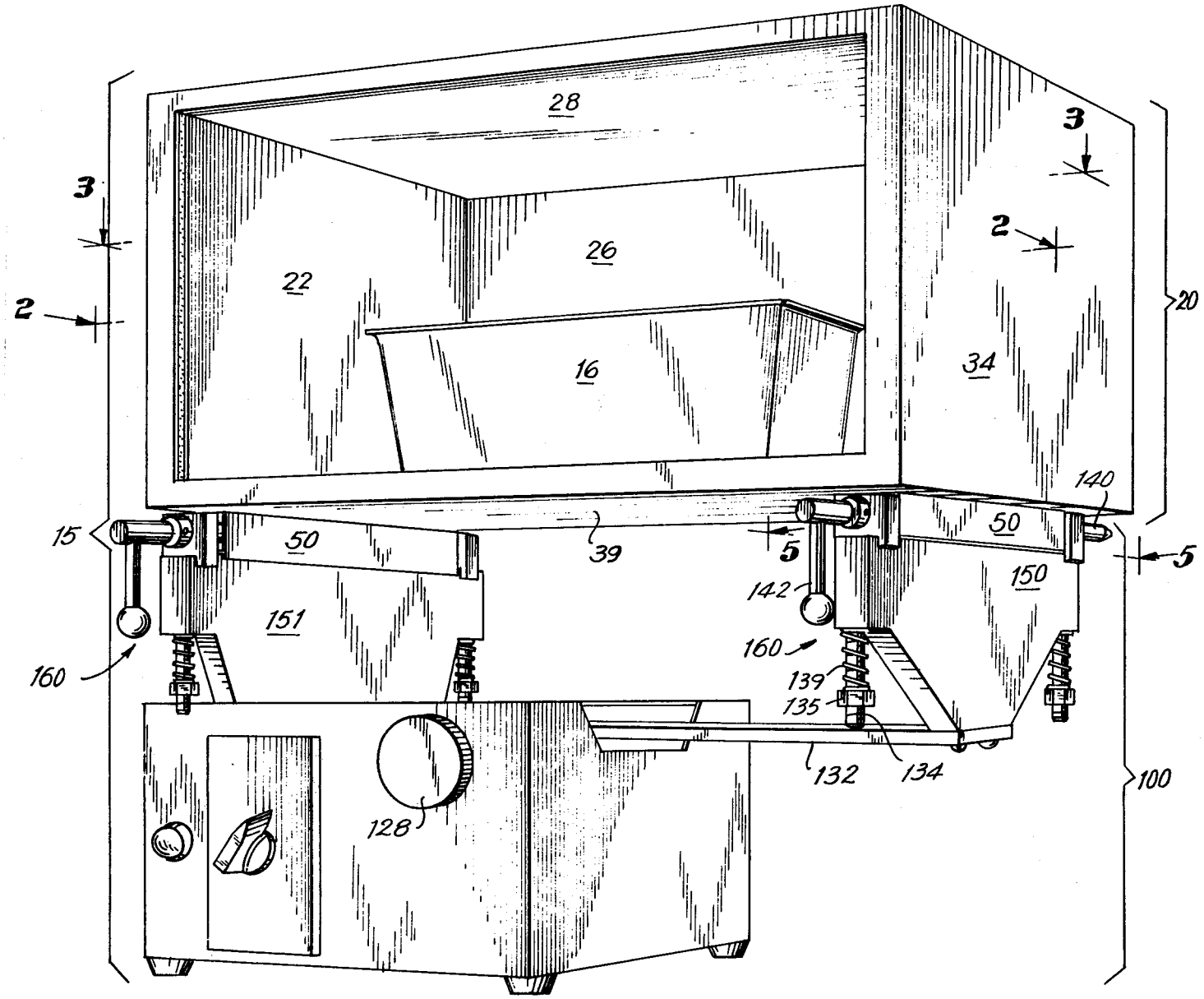
FIG. 1 is a perspective view of one embodiment of my invention.
Figure 2:
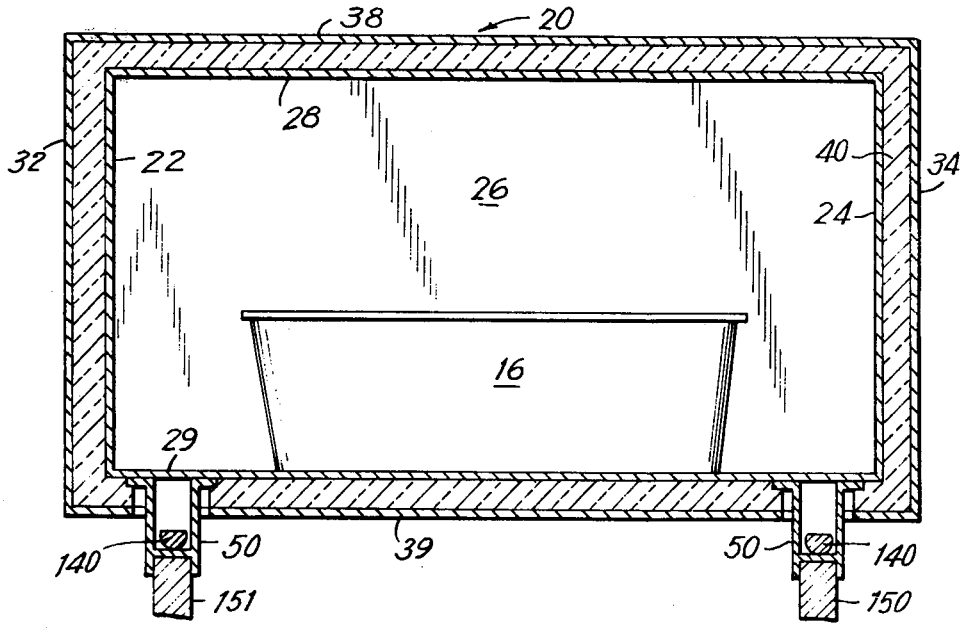
FIG. 2 is a front view, in section, taken along the section lines 2—2 of FIG. 1.
Figure 3:
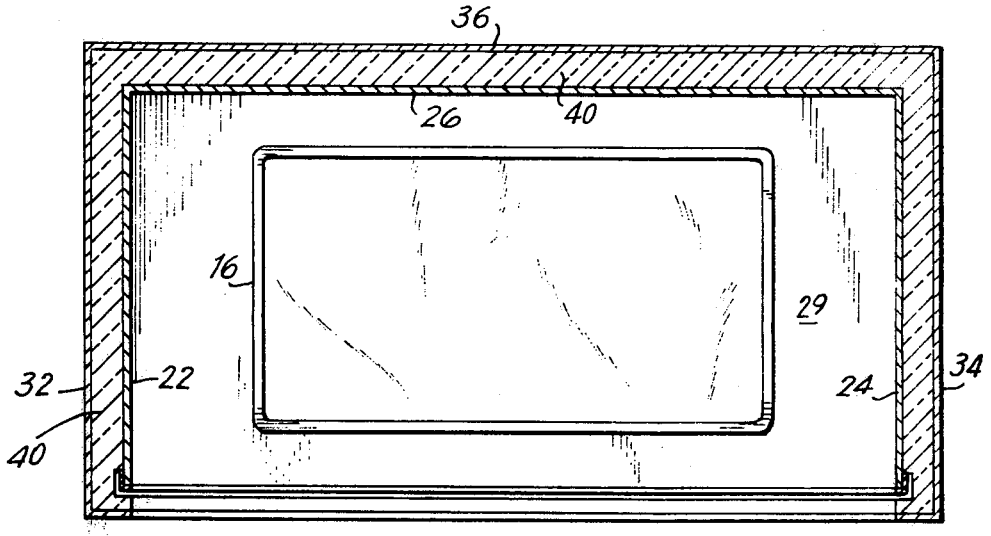
FIG. 3 is a top view, in section, taken along the section line 3—3 of FIG. 1.
Figure 12:
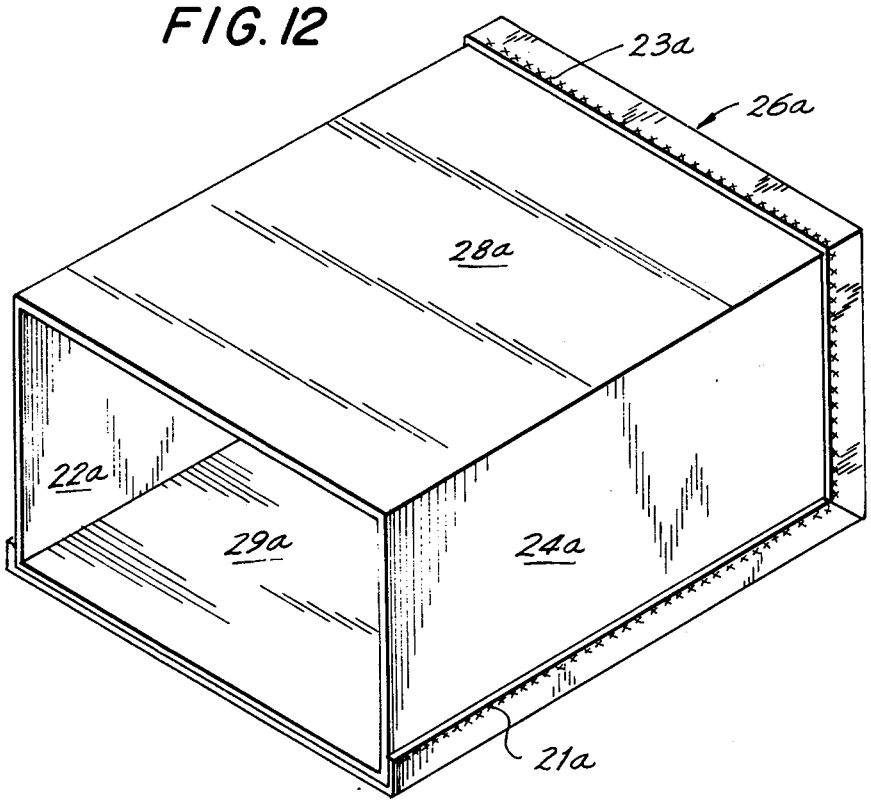
FIG. 12 is a perspective view of a component of the oven shown in FIG. 1.

The embodiment of my invention shown in FIG. 1 includes two major components, namely an oven 20 and a power supply unit 100. As shown in FIGS. 1, 2 and 3, the oven 20 includes inner side walls 22, 24, an inner back wall 26, an inner top wall 28 and an inner bottom wall 29. Spaced apart from the foresaid inner walls are outer walls 32, 24, an outer back wall 36, an outer top wall 38 and an outer bottom wall 39. Preferably, insulation 40 is provided between each of the respective inner and outer walls. Each of the inner walls is preferably a flat and substantially unbroken sheet of metal and the inner walls are mechanically and electrically interconnected. Particularly preferable is a construction wherein the inner side, bottom and top walls are of unitary construction, i.e. formed from a single piece of sheet material, and the inner side walls are spot welded to the inner bottom wall and the inner back wall is spot welded to the inner side and top walls. This construction is shown in FIG. 12 wherein a single sheet of material has been formed into a U-shape, thereby defining inner side walls 22*a* and 24*a* and inner top wall 28*a*. Bottom wall 29*a* is spot welded to the side walls as shown in 21*a*. The back wall 26*a* is spot welded to the top and side wall as shown at 23*a*.

The oven 20 shown in FIG. 1 is provided with a pivotally and preferably removably mounted door which, for clarity, is not shown in the drawings.

Figures 5, 6, 7, 8:
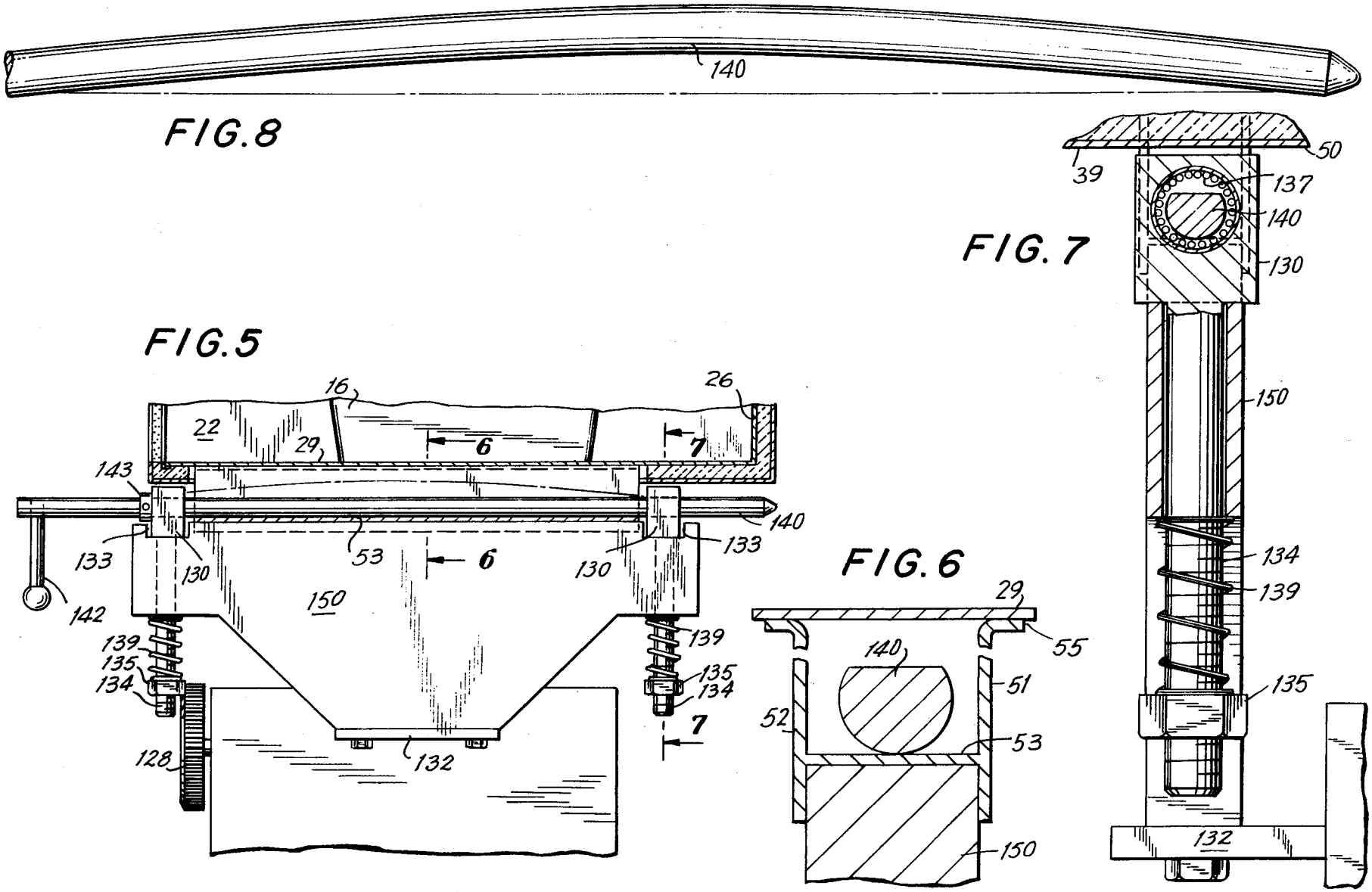
FIG. 5 is a side view, partially in section, taken along the section lines 5—5 of FIG. 1.
FIG. 6 is a fragmentary sectional view taken along the section lins 6—6 of FIG. 5.
FIG. 7 is a sectional view taken along the section lines 7—7 of FIG. 5.
FIG. 8 is a side view of one of the components of the apparatus shown in FIG. 1.

As best seen in FIGS. 2 and 6, a pair of H-shaped electrical members 50 are secured to the inner bottom wall 29 and extend downwardly therefrom. The electrical contact members preferably extend along a substantial portion of the depth of the oven and are connected to the bottom wall along a substantial depth so as to achieve a reasonably even current distribution in the wall of the oven.

The members 50 are identical in construction and a representative one of these members is shown in FIG. 6. As may be seen in FIG. 6, the member 50 is comprised of vertically disposed members 51, 52 and a lower, horizontally disposed member 53. Each of the members 50 is secured to the inner bottom wall 29, e.g. by spot welding as shown as 55 in FIG. 6. For clarity, the insulation 40 and the outer bottom wall 39 is not shown in FIG. 6.

When the oven 20 is to be operated, it is connected to a power supply, for example a power supply of the type shown in FIG. 1 at 100. To make this connection, clamps 160, 161 may be employed. The construction of the clamps and the power supply unit will hereinafter be described. At this point, suffice it to say that the power supply unit, when activated and when connected to the oven 20, will impose an AC voltage of approximately 1 volt across the electrical contact members 50.

What the oven 20 has been mounted on the power supply unit 100 as shown in FIG. 1, an article to be cooked may be placed within the oven 20 through the front opening. As previously stated, the oven 20 is provided with a door covering the front opening, the door being preferably pivotally and removably mounted. FIG. 1 shows a cake pan 16 positioned within the oven 20. Preferably, the interior of the oven defines a volume of at least, approximately one-fourth cubic feet.

After the article to be cooked is placed within the oven and the front door is closed, the power supply unit 100 may be activated.

Referring particularly to FIG. 2, when the power supply unit is activated a voltage of approximately 1 volt is impressed across the electrical contact member 50. As a result, it will be seen by reference to FIG. 2 and 3 that a current will flow through all of the inner walls of the oven 20. More specifically, there will be a primary current flow path through the bottom inner wall 29 and a secondary current flow path through the inner walls 22, 24 and 28 and also preferably the inner back wall 26 of the oven 20. As a result of the current flowing through the inner walls, the space within the oven is heated to a food cooking temperature, for example a temperature in the range of approximately 100 to 500° F, and thereby the food within the oven is cooked.

In general, it is preferred that the walls be constructed of metal and have a thickness in the range of approximately 0.01 to 0.05 inches. To achieve optimum heating within the oven, it may be preferable to adjust the thickness of the various inner walls whereby a particular distribution of the electric current may be obtained. For example, the linear resistance (ohms/foot) of the bottom wall may be greater than the linear resistance of the other walls, in order to insure that the same current or even less current flows through the bottom wall than through the other walls. A desired current distribution may be obtained by varying the thickness of the walls or the wall material or both.

A prototype of the oven 20 shown in FIG. 1 had an interior width of approximately 15 inches, an interior height of approximately 7.5 inches and a depth of approximately 12 inches. In this prototype all of the inner or interior walls were made of stainless steel. More particularly, the inner bottom wall 29 had a thickness of approximately 0.02 inches, the inner side walls and the inner top wall had a thickness of approximately 0.025 inches and the back wall had a thickness of approximately 0.02 inches. The front of the oven was closed with a pivotally mounted glass door which has been removed from a conventional calrod type broiler oven. The electrical contact members 50 were each comprised of brass sheet stock having a thickness of approximately 0.02 inches. The brass stock was bent into an approximate H configuration and the upper, outwardly extending portions were spot welded to the bottom inner wall 29. The electrical contact members were approximately 9 inches long. The inner walls were electrically and mechanically interconnected. An aluminum shell constructed of aluminum having a thickness of 0.025 inches provided the outer walls of the oven, i.e. the inner wall structure was slid into the aluminum shell. Insulating spacers were employed to maintain the spacing between the inner wall structure and the aluminum shell. Approximately one-half inch of insulation was provided between the inner wall structure and the outer shell. In this prototype, the insulation was comprised of a sheet of aluminum foil having a thickness of approximately 0.001 and an outer layer of fiberglass insulation. The resulting structure weighed approximately 11 pounds.

To test the prototype described above, the oven was mounted as shown in FIG. 1. In the first test, a premixed pound cake recipe was employed wherein the premix was supplied in an aluminum tray which was approximately 9.5 inches by 5.5 inches by 2.75 inches. A thermocouple was positioned in approximately the center of the space defined by the oven and a watt meter was connected to the input line to the power supply. The pound cake premix was placed within the oven, the door closed and the power supply activated, whereby there was imposed a voltage of approximately 1 volt, 60 cycle across the members 50. The following data was recorded.

| Time (Min.) | Power (Watts) | Temperature (degrees F) |
|---|---|---|
| 0 | 1040 | 77 |
| 5 | 920 | 220 |
| 10 | 900 | 300 |
| 15 | " | 350 |
| 20 | 890 | 370 |
| 25 | 880 | 385 |
| 30 | " | 400 |
| 35 | " | 425 |

After 35 minutes, the power supply was turned off and the pound cake removed from the oven. The visible surfaces of the pound cake were a golden brown in color and uniform on the top and sides. The bottom was somewhat darker in color suggesting the need to elevate the aluminum tray so as not to be in contact with the inner bottom wall of the oven or to use a thinner material in the bottom so that less heat is generated in the bottom wall. The pound cake had risen and appeared to be fully cooked.

The significance of this test may be noted by the fact that the directions which accompanied the pound cake premix stated that, when the mix was cooked, the oven should be preheated at 325° F for 15 minutes and then the premix should be baked at 325° F for 75 minutes. In other words, if the directions were followed and a conventional oven was employed, the total cooking time would be 90 minutes whereas, as indicated above, in a prototype oven embodying my invention the same premix pound cake was cooked in 35 minutes.

In another test, a three pound chicken was placed in an aluminum tray and then placed within the above described prototype oven and the door was closed. Prior to closing the door, a thermocouple was inserted into one leg of the chicken and a second thermocouple was positioned within the oven to measure the air temperature within the oven. Also, a watt meter was connected to the input to the power supply unit. Thereafter, with the door closed, the power supply unit was turned on (the output from the power supply unit was approximately 1 volt) and the following data was recorded.

| Time (Min.) | Power (Watts) | Chicken Temp. (degrees F.) | Air Temp. (degrees F.) |
|---|---|---|---|
| 0 | 1070 | 57 | 80 |
| 5 | 1080 | 62 | 225 |
| 10 | 940 | 75 | 300 |
| 15 | 920 | 93 | 335 |
| 20 | " | 115 | 355 |
| 25 | " | 135 | 370 |
| 30 | " | 150 | 380 |
| 35 | " | 162 | 382 |
| 40 | " | 175 | 385 |
| 45 | " | 190 | 390 |

When the chicken was removed, the top, sides and bottom thereof were a light brown and the skin was crisp. The interior of the chicken was found to be well cooked and quite juicy. There was no trace of blood in the interior of chicken.

In both of the tests referred to above, power was continuously supplied to the oven during the test. With respect to the test involving a chicken, it may be noted that if the average power input to the oven is assumed to have been 1,000 watts, the chicken was cooked with a specific power expenditure of only 234 watt-hours per pound.

Figure 2A:
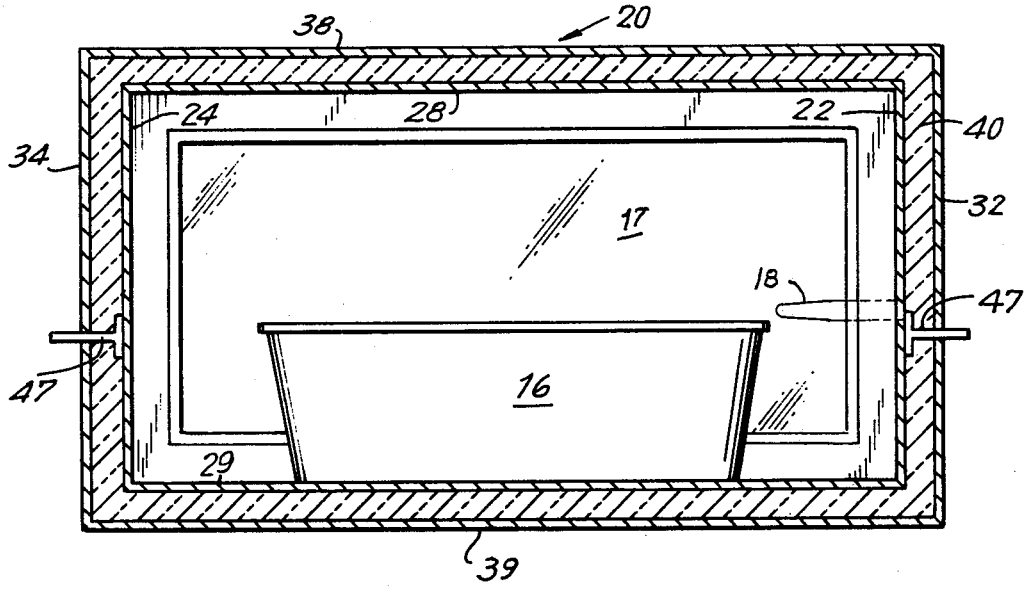
FIG. 2A is a sectional view of another embodiment of my invention wherein the view is taken looking toward the front of the oven.

In another prototype oven, the electrical contact members, extended outwardly from opposite sides of the oven as shown in FIG. 2A. Also shown in FIG. 2A is a glass panel door 17, which closes the front of the oven, and a handle 18 on the door. The interior of this oven was approximately 12 inches deep, 12 inches wide and 9 inches high. The inner side walls, back wall, top wall and bottom wall were all interconnected and were made of stainless steel having a thickness of approximately 0.02 inches. The electrical contacts extended outwardly from the sides walls of the oven and were made of brass having a thickness of approximately 0.02 inches. The brass contact members were spot welded to the inner side walls approximately four inches from the bottom of the oven and extended rearwardly approximately 8 inches. The front of the oven was closed with an insulated door. The outer shell of the oven was aluminum having a thickness of approximately 0.025 inches. Approximately one half inch insulation was provided between the inner and outer walls. The oven was mounted on and clamped in a power supply unit of the tape shown in FIG. 1. To test this oven, a chicken weighing approximately 3 pounds was placed in the oven and rested in an aluminum foil tray. Taps on the primary of the power supply transformer were adjusted to provide a secondary voltage of approximately one volt. A thermocouple was positioned in the oven to measure the air temperature and a thermocouple was positioned in one of the legs of the chicken. Also, a watt meter was connected to measure the power into the power supply unit. The test was begun and power was supplied to the oven during the entire test. The following results were noted.

| Time (Min.) | Power (Watts) | Chicken Temp. (degrees F.) | Air Temp. (degrees F.) |
|---|---|---|---|
| 0 | 900 | 57 | 80 |
| 5 | 830 | 63 | 230 |
| 10 | 800 | 77 | 320 |
| 15 | 790 | 92 | 365 |
| 20 | " | 108 | 380 |
| 25 | 780 | 125 | 400 |
| 30 | 770 | 137 | 420 |
| 35 | " | 148 | 430 |
| 40 | " | 160 | " |
| 45 | " | 172 | 435 |
| 50 | " | 195 | " |

At the end of the test, the chicken was found to be very evenly cooked, a light brown in color and with no blood on the inside. Considering 790 watts as the average power input, it may be noted that the chicken was cooked with a specific power consumption of only 220 watt-hrs./lb.

Reflecting further on the test data set forth above, as previously stated the tests were conducted with continuously supplied power. In other words, modulation of the power was not used. In other prototypes of my invention, I have connected the thermocouple measuring the air temperature to a thermostat and a high power tap on the transformer is employed to essentially over power the oven. When the temperature within the oven reaches the desired temperature, current flow to the oven is controlled. While this approach is within the scope of my invention, it is significant to note that impressive cooking results have been obtained without control or modulation of the power input. For example, the temperature of the oven can be varied by changing the number of primary windings by the use of taps. Thereby, the input power can be adjusted to match power losses and a specific temperature can be maintained. In this case, a thermostat is not needed. Thus, although in the test described above the power input to the oven was controlled by a thermostat, the cooked articles and articles cooked in other tests were not burned. Clearly, this result is in contradistinction to conventional domestic cooking ovens which employ a local, high temperature heat source. Hence, it appears to be an aspect of my invention that food articles may be cooked with a relative absence of control. In this regard, another aspect of my invention appears to reside in the fact that efficient and rather fast cooking is secured, notwithstanding the fact that the heat source is at a temperature lower than a 1,000° F, i.e. a temperature substantially lower than the temperatures associated with heat source in conventional, domestic cooking ovens. In tests which I have conducted, the temperature of the walls of prototype ovens has not exceeded approximately 600° F. Yet, food cooking temperatures have been maintained and efficient cooking of food has been achieved.

Another particularly attractive attribute of my invention is the fact that in at least certain embodiments, for example the embodiment of FIG. 1, the oven may be entirely removed from the power unit and may easily be cleaned. Thus, the interior of the oven presents a completely smooth surface and is notable by the absence of bumps, protuberances of small breakable devices. As a result, cleaning of the oven is a relatively easy task. Indeed, as an index of the ease with which an oven may be cleaned which embodies my invention, it should be noted that an oven of the type shown in FIG. 1 may be constructed so as to be water tight. In this manner, the entire oven may be removed and placed within a dishwasher.

Consonant with the ease with which the oven may be cleaned, it should also be noted that the oven is easily removable from the associated power unit without the use of any tools, such as a wrench or screwdriver, and, because the oven is light, it is easly moved from one place to another.

The Power Supply Unit

Figure 4:
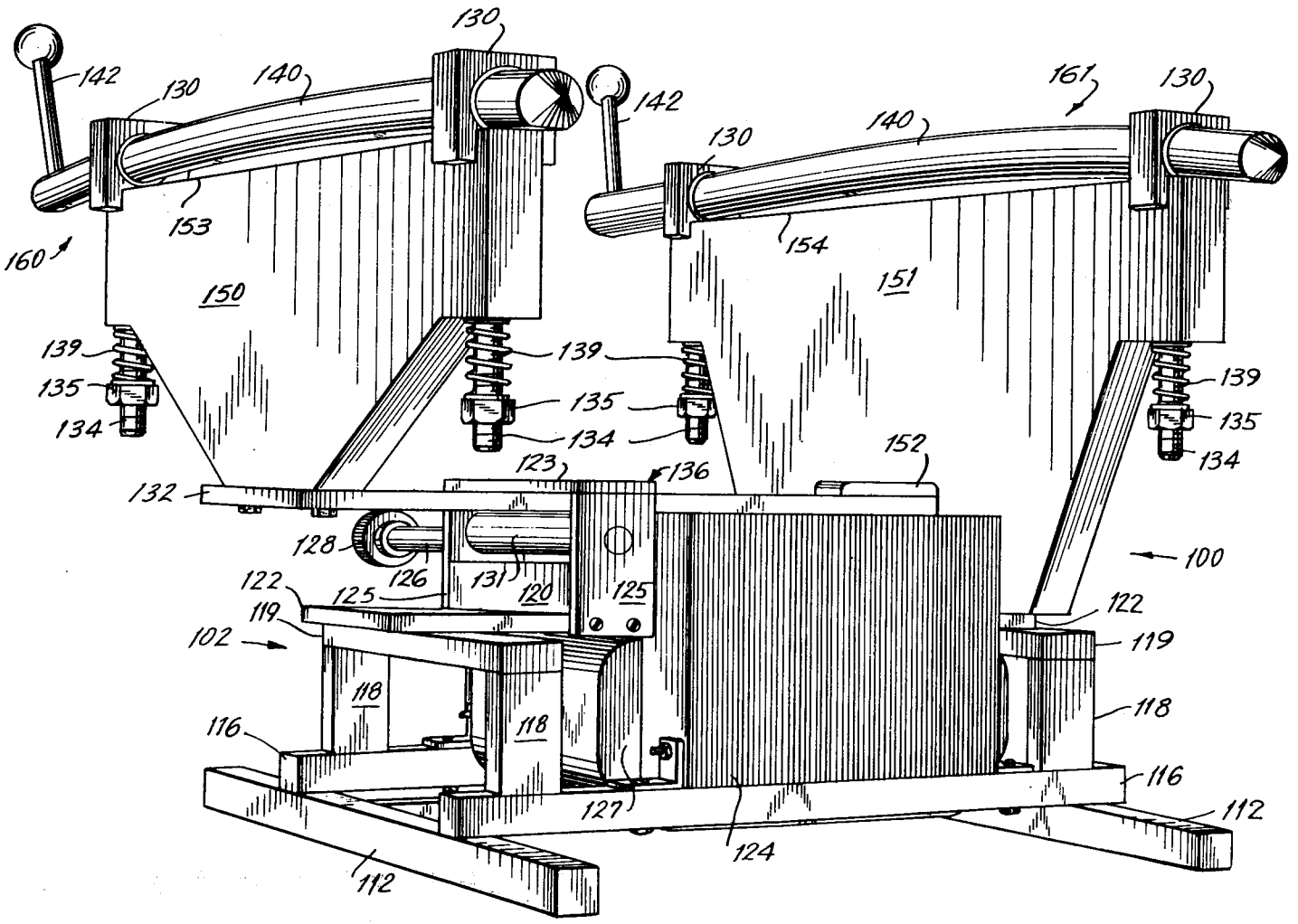
FIG. 4 is a perspective view of one of the components shown in FIG. 1.

FIG. 4 provides a more detailed view of the power supply unit 100. The view of FIG. 4 shows the power supply unit from the rear with respect to the view of FIG. 1. Additionally, FIG. 4 shows the power supply unit with the cover removed from the bottom housing.

Referring to FIG. 4, the power supply unit 100 includes longitudinal support members 116 and transverse support members 112 which, together, comprise a frame 102. The support members may be secured together by any conventional means such as by welding or machine screws.

At each longitudinal end of the frame 102, a pair of spacer blocks 118 are secured to the support members 116 and extend upwardly. Secured to the top of each pair of spacer blocks 118 is an insulator block 119. A transformer core 124 is mounted on the frame 102, i.e. the transformer core 124 is secured to the longitudinal support members 116.

Figure 11:
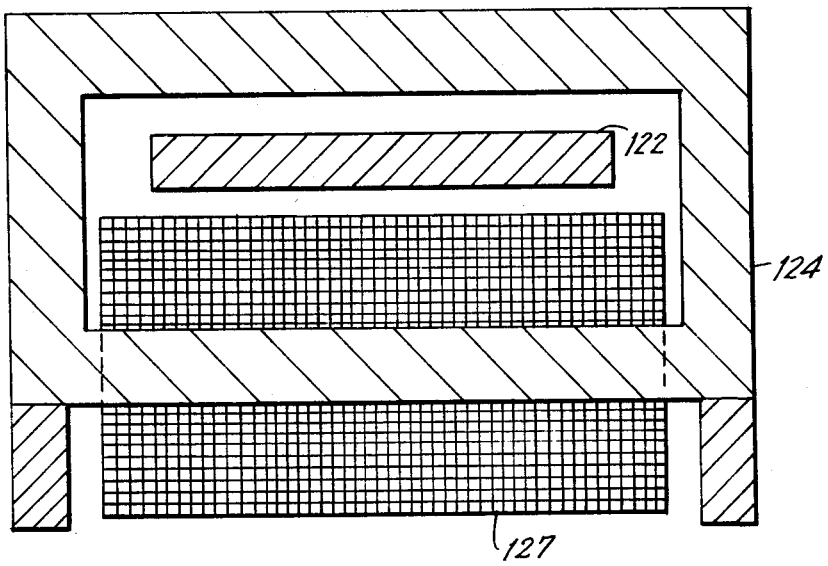
FIG. 11 is an end view of a component of the apparatus shown in FIG. 4.

As shown in FIG. 11, primary winding 127 is wound around the lower portion of the transformer core 124. Extending through the transformer core, and preferably not in contact with the transformer core, is rigid bus bar 122 which is preferably made of copper. Preferable dimensions for the bus bar 122 are approximately 3 inches wide by a quarter inch thick. The bus bar 122 forms the secondary winding for the transformer.

Returning to FIG. 4, a pair of upwardly extending plates 125 are secured to the bar 122. The plates 125 may be secured to the bar 122 by machine bolts 121. A plate 123 extends between and is connected to the plates 125. Preferably, the plates 123 and 125 are all made of copper or some other highly conductive metal. A shaft 126 extends through the plates 125 and is rotatably mounted therein. A knob 128 is secured to the end of the shaft 126. Eccentrically mounted on the shaft 126 is a cylindrical clamping member 131. Instead of an eccentrically mounted cylindrical member, a centrally mounted elliptical shaft may be employed. A block 120 is mounted below the cylindrical member 131 and is secured by appropriate means to the plate 125.

Extending between the plates 125 and above the cylindrical member 131, but below the plate 123, is a second bus bar 132 which, preferably, is a copper bar having approximately the same dimensions as the bar 122.

Figure 9:
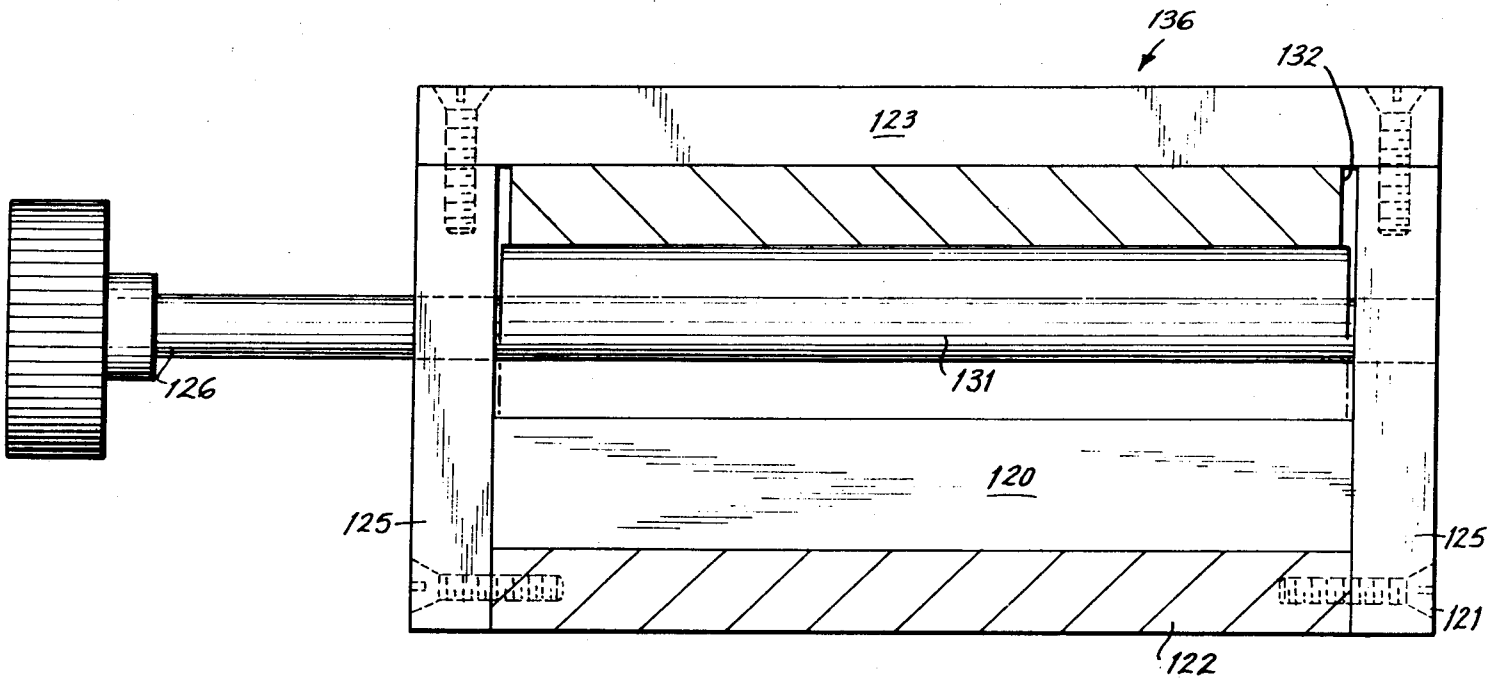
FIG. 9 is a side view of one of the component parts of the apparatus shown in FIG. 4.

The construction comprised of the plates 123, 125 and the block 120 and the cylindrical member 131, together with the shaft 126, may be designated as a clamping means 136. The clamping means 136 is shown, partially in section, in FIG. 9.

Referring again to the apparatus 100 of FIG. 4, there are provided two pedestal members 150, 151, each of which is made of an electrically conductive material, for example aluminum. The pedestal member 151 is fixedly secured to and in electrical contact with the bus bar 122. Additionally, the pedestal member 151 includes an appropriately shaped aperture 152 through which the bar 132 may extend. The bar 132 is either not in physical contact with the side walls which define the apertures 152 or, alternatively, insulation is provided between the bar 132 and the side walls of the aperture 152.

The pedestal 150 is fixedly secured to and in electrical contact with the bar 132. The height of the pedestals 150, 151 is different and is adjusted such that upper surfaces 153, 154 are disposed in a common, substantially horizontal plane.

Each of the pedestal members 150, 151, is provided with a pair of bearings 130. As shown in FIG. 5 with respect to the pedestal 150, the bearings 130 are disposed in slots 133 which are cut in the top of the pedestal members. Additionally, in accordance with this preferred embodiment of my invention, a stem 134 is secured to each of the bearings 130 and extends downwardly through the pedestal member. The lower portion of each stem 134 is threaded. A helical spring 139 is disposed around each stem and interposed between the bottom portion of the pedestal member and a nut 135. In this manner, the precompression of each of the springs 139 may readily be adjusted by rotating the associated nut 135.

On each pedestal member there is provided a shaft 140 which is received in associated pairs of bearings 130. At one end of each of the shafts 140, there is provided an arm 142 to facilitate rotation of the shaft 140. A collar 143 may also be provided. Also, as shown in FIG. 7, I prefer to include friction reducing means in the form of needle bearings 137 within each of the bearings 130.

Each of the shafts 140 is bowed as shown most clearly in FIG. 8. Additionally, to facilitate the clamping of a sheet of material, each of the shafts 140 have been cut to remove a circular segment thereof as may be seen in FIGS. 6 and 7.

When the apparatus 100 of FIG. 4 is to be used, the spacing between the clamps 160, 161 may be adjusted. This spacing adjustment may conveniently be accomplished by rotating the knob 128 so as to position the cylindrical member 131 against the block 120, thereby freeing the bar 132. Thereupon, the clamp 160 may be moved toward or away from the clamp 161 until the desired spacing is achieved. Then, the knob 128 is rotated so as to bring the cylindrical clamping surface 131 in contact with the bar 132 whereby the bar 132 is tightly clamped between the cylinder 131 and the plate 123. It has been found that little more than finger tip rotational force is needed to tightly clamp the bar 132 by using the clamping system 136, i.e. with little more than finger tip rotational force on the knob 128, the bar 132 is tightly clamped and a particularly low resistance contact is obtained between the bar 132 and the plate 123 and the cylinder 131. In this regard, it should be noted that the cylinder 131 and the shaft 126 are also preferably made of copper whereby current may flow from the plates 125 to both surfaces of the bar 132.

After the desired spacing between the clamps 160, 161 has been adjusted so as to be equal to the spacing between electrical contact members 50 of the oven 20 of FIG. 1, the movable clamp is then locked in position. The two shafts are then each rotated so that the handles 142 are pointing upwardly. The shafts 142 are then each removed by simply pulling them out. The oven is then placed on top of the power supply unit 100 so that the electrical contact members 50 are nested on top of the pedestals 150, 151, as shown in FIG. 6. After the electrical contact members are positioned on the pedestals, the shafts 140 are reinserted and then rotated so as to clamp the contact members 50, as shown in FIG. 6.

When the electrical contact members 50 have been clamped, power may be supplied to the primary 127 of the transformer whereby, current will flow through the bus bar 122, through the clamping mechanism 136, from the clamp 160 through the oven to the clamp 161, and then through the pedestal member 151 to the bus bar 122. Thus, a voltage of approximately one volt will be impressed across the electrical contact members 50 and current will flow through the inner walls of the oven as previously described.

As will be seen from an inspection of the drawings, each of the shafts 140 is bowed. Therefore, upon rotation of the shafts 140, the center portion of each of the shafts 140 will initially contact the horizontal portions 53 of the contacts 50. After such contact has been achieved, further rotation of each of the shafts 140 will cause upward forces to be imposed upon the bearings 130. Such upward forces are resisted by the springs 139. Thus, upon rotation after the initial contact, the bearings 130 will move upwardly by a relatively small amount thereby compressing the springs 139 and increasing the downward spring forces on the bearings 130. In response to these downward forces and further rotation of the shaft, the shafts 140 will straighten such that the sheet material 53 is tightly sandwiched between the shaft and the top surface of the pedestal member. Also, because of the rotational movement of the shafts 140, a wiping contact is obtained between each of the shafts and a sheet of electrically conductive material, i.e. as the shaft comes into contact with the sheet, a wiping action occurs. Also, since the shaft is round or curved, a line or tangential contact is achieved between the shaft clamping member and the sheet. As a result, a surprisingly efficient clamping is achieved. Indeed, the clamping action is so efficient that other sheets of conductive material, having a thickness in the range of 0.0005 to 0.125 may be clamped so that a current greater than 100 amperes will flow through the sheet with an applied voltage of approximately one volt. Thus, the power supply unit may be used to clamp other sheets of conductive material which may then be heated to cook foods.

Because of the low voltage which is used, the electrical contact members 50 must be clamped, across their entire length, in a substantially uniform manner, i.e. in the absence of good physical contact between clamping members 160, 161 and an electrical contact member 50, an electrical current will flow through only a narrow width of the sheet. When a rotatable shaft is employed to effect such a clamping action, close tolerances usually must be achieved with respect to the straightness of the shaft and the uniformity of its diameter. Similarly, any associated fixed or pedestal member must have a surface which is flat and parallel with the shaft. Additionally, the members which are employed to rotatably mount the shaft must be precisely aligned so that the center line of the shaft is exactly parallel with the clamping surface of the pedestal. While it is possible to achieve such alignment and uniformity, it will be appreciated that a substantial expense is required in order to reliably produce such an apparatus. A device of the type shown in FIG. 4 does not require the high manufacturing tolerances which would be required with other devices. As a result, irregularities in the sheet of conductive material or slight misalignments in the apparatus are automatically compensated by the deformation of the bowed shaft which occurs when the shaft is rotated into contact with the sheet material. Thus, I have found that an apparatus embodying the construction of FIG. 4 may be constructed without the close manufacturing tolerances of other devices, while nevertheless providing a good electrical contact with sheets of varying thicknesses and also providing removability of the shafts 140.

Still another noteworthy facet of the construction shown in FIG. 4 and 7 is the provision of the friction reducing means, for example the needle bearings 137.

To insure a deformation of the springs and a high pressure, low resistance clamping action, the top surface of the bottom-most bearing 137 should be slightly below the top surface of the associated pedestal. With this construction and an appropriate sizing of the internal diameter of the bearings, it is insured that there will be some deformation of the springs when even a very thin sheet is clamped. For example, it has been found that if the top surface of the lower-most bearings is between five to ten thousandths of an inch below the top surface of the associated pedestal, then a strain of at least a few thousandths of an inch is imposed upon the springs when a sheet of conductive material is clamped having a thickness of 0.005 inches.

As a specific example of the construction of FIG. 4 and which has been successfully tested, the shaft 140 may be made of five eighths inch diameter 303 stainless steel wherein the removed segment is approximately one eighth inch in height.

In one embodiment of this construction, the bearings 130 had a height of approximately 1.125 inches and a width of approximately 0.75 inches. Each of the bearings was provided with an integral stem approximately 3.875 inches in length and threaded at the end to receive a conventional machine nut. Each of the springs was precompressed to provide a precompression force of approximately 70 pounds. To provide this force, the springs used were made of steel wire having a diameter of approximately 0.11 inches. Each of the springs was approximately one inch long and the outer diameter of the overall spring was approximately one half inch. By screwing each of the machine nuts on to the stem, each of the springs were precompressed to provide the aforementioned precompression force of approximately 70 pounds.

Returning to the bow provided in each of the shafts 40, with a stainless steel shaft having a diameter of five eighths inches it has been found that a deformation of approximately five sixteenths inches is required to impart a permanent deformation of approximately 0.012 inches over a 10 inch length. Moreover, if the permanent deformation is provided by supporting the shaft on supports spaced 10 inches apart and then applying a force to the center of the shaft, it has been found that the deforming force at the center of the shaft should be distributed over approximately 4 inches of the shaft. In other words, the deforming force should not be applied at a single point at the center of the shaft. Rather, a plate is preferably placed on top of the shaft and the forces applied to the plate whereby the force is distributed along a portion of the shaft.

Wall Oven

Figure 10:
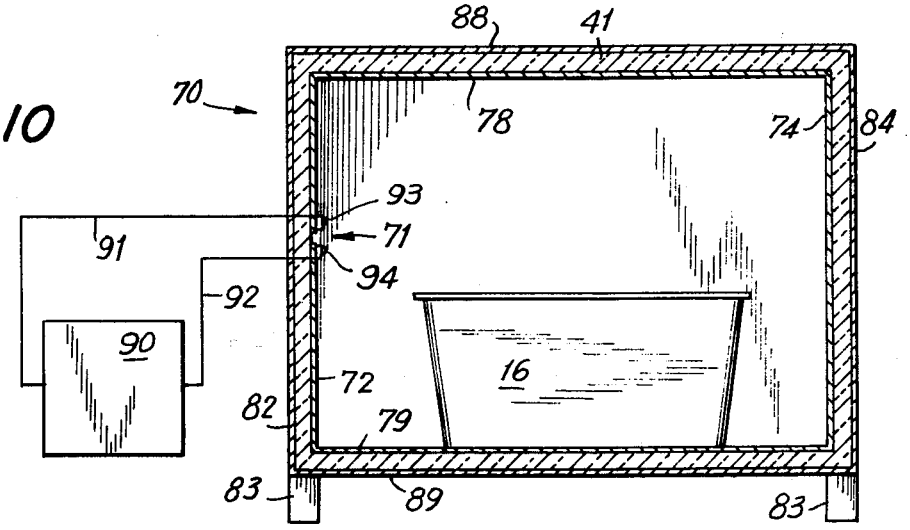
FIG. 10 is a side view of another embodiment of my invention.

FIG. 10 shows a somewhat schematic representation of an apparatus 70 which represents another embodiment of my invention. This apparatus represents a construction which, in normal use, would not be separated from the associated power supply. For example, the apparatus 70, when appropriately packaged, would be usable as a wall oven.

Referring to FIG. 10, the oven 70 includes inner side walls 72, 74, an inner top wall 78, an inner bottom wall 79 and an inner back wall 76. Spaced outwardly from the inner walls are outer walls which include outer side walls 82, 84, an outer top wall 88, an outer bottom wall 89 and an outer back wall which is not shown in FIG. 10. The oven 70 may be provided with legs 83 if it is to be used on a counter top. Alternatively, as previously stated, the entire unit may be self-contained and built into a wall to function as a wall oven.

Although not shown in FIG. 10, the oven 70 would be provided with a door closing the front thereof.

As seen in FIG. 10, the inner side wall 72 is not continuous. Rather, as shown at 71, there is an interruption in the continuity of the side wall 72. The upper portion of the side wall 72 is connected at 93 to a transformer 90 by line 91. Similarly, the lower portion of the inner side wall 72 is connected at 94 to the line 92 which connects to the transformer 90. At least the inner side walls, the inner bottom wall and the inner top wall are electrically conductive and are electrically and mechanically interconnected so as to define an electrical circuit which terminates at the contacts 93, 94. Additionally, if desired, the back wall 76 may also be electrically conductive and electrically and mechanically interconnected with the other inner side walls. Preferably, all of the inner walls are made of metal, for example stainless steel, having a thickness in the range of approximately 0.01 to 0.05 inches, and each wall presents a smooth, substantially unbroken surface.

In operation, the embodiment of FIG. 10 functions in a manner similar to the operation of the embodiment earlier described. Thus, the transformer 90 is a step-down transformer which, when its primary is connected to 120 volts 60 cycle AC, will produce a voltage on the secondary of approximately one volt. Thus, when the transformer 90 is activated, a voltage of approximately one volt is impressed across the contacts 93, 94 and, thereby, current flows through the inner walls of the oven in an amount sufficient to heat the interior of the oven to a food cooking temperature, for example a temperature in the range of approximately 100 to 500° F.

In a prototype oven of the type shown in FIG. 10, the transformer 90 was affixed to one of the exterior side walls. Alternatively, the transformer 90 may be positioned underneath the oven.

I claim:

1. A food cooking oven which comprises:

a. exterior side, bottom, top and back walls;

b. a thermally insulated door closing the front of said oven;

c. interior walls spaced inwardly from said exterior walls and defining the interior of said oven, said oven interior having a volume of at least, approximately, 0.25 cubic feet, said exterior and interior walls together defining a substantially rigid, self-supporting structure, said interior walls being electrically conductive;

d. thermal and electric insulation means disposed between said interior and exterior walls; and e. a pair of rigid, spaced apart, electrical contact members, said contact members being secured to and in electrical contact with at least one of said interior walls and extending along a substantial portion of the depth of said oven and extending outwardly through and beyond the adjacent exterior wall, each of said contact members being adapted to be received within a respective one of a pair of clamps which are connected to a low voltage, high current power supply whereby a non-hazardous, low voltage is impressed across said contacts and thereby an electrical current flows through said interior walls in an amount sufficient to heat the interior of said oven to a food cooking temperature.

2. The food cooking oven of claim 1 wherein said thermally insulated door includes a single pane glass panel.

3. The food cooking oven of claim 2 wherein said door is removably mounted on said oven.

4. The food cooking oven of claim 1 wherein said interior walls have a thickness in the range of, approximately, 0.01 to 0.05 inches.

5. The food cooking oven of claim 4 wherein said interior walls are stainless steel.

6. The food cooking oven of claim 1 wherein said interior walls are interconnected to form a water tight structure.

7. A food cooking oven which comprises:

a. exterior side, bottom, top and back walls;

b. a door closing the front of said oven;

c. an interior back wall and electrically conductive and interconnected interior side, bottom and top walls, said interior walls being spaced inwardly from said exterior walls, said interior and exterior walls together defining a substantially rigid, self-supporting structure, said interior walls defining a volume of at least, approximately, 0.25 cubic feet;

d. thermal and electric insulation means disposed between said interior and exterior walls; and e. a pair of rigid, spaced apart, electrical contact members, said contact members being secured to and in electrical contact with at least one of said interior walls and extending along a substantial portion of the depth of said oven and extending outwardly through and beyond the adjacent exterior wall, each of said contact members being adapted to be received within a respective one of a pair of clamps which are connected to a low voltage, high current power supply whereby a non-hazardous, low voltage is impressed across said contacts and thereby an electrical current flows through said interior walls in an amount sufficient to heat the interior of said oven to a food cooking temperature.

8. The food cooking oven of claim 7 wherein said electrical contact members are secured to and in electrical contact with said bottom wall of said oven.

9. The food cooking oven of claim 8 wherein said interior walls have a thickness in the range of, approximately, 0.01 to 0.05 inches.

10. The food cooking oven of claim 7 wherein said interior walls are stainless steel.

11. The food cooking oven of claim 7 wherein each of said electrical contact members is secured to and in electrical contact with a respective one of said side walls of said oven.

12. The food cooking oven of claim 11 wherein said interior walls have a thickness in the range of, approximately, 0.01 to 0.05 inches.

13. The food cooking oven of claim 12 wherein said interior walls are stainless steel.

14. The food cooking oven of claim 7 wherein said interior walls are unitary and formed by deep drawing.

15. A food cooking apparatus which comprises:

a. a food cooking oven comprising,
   i. exterior side, bottom, top and back walls,
   ii. a thermally insulated door closing the front of said oven,
   iii. interior walls spaced inwardly from said exterior walls and defining the interior of said oven, said oven interior having a volume of at least, approximately, 0.25 cubic feet, said exterior and interior walls together defining a substantially rigid, self-supporting structure,
   iv. thermal and electric insulation means disposed between said interior and exterior walls, and
   v. a pair of rigid, spaced apart, electrical contact members, said contact members being secured to and in electrical contact with at least one of said interior walls and extending along a substantial portion of the depth of said oven and extending outwardly through and beyond the adjacent exterior wall, b. a power supply unit disposed beneath said food cooking oven, said power supply unit comprising,
   i. a frame,
   ii. a pair of clamps mounted on said frame, each of said electrical contact members being disposed within a respective one of said clamps, and
   iii. means connected to said clamps for impressing across said clamps a low, non-hazardous voltage whereby, in response to said voltage, an electrical current flows through said oven in an amount sufficient to heat the interior of said oven to a food cooking temperature.

16. The food cooking oven of claim 15 wherein said thermally insulated door includes a single pane glass panel.

17. The food cooking oven of claim 16 wherein said door is removably mounted on said oven.

18. The food cooking oven of claim 15 wherein said interior walls have a thickness in the range of, approximately, 0.01 to 0.05 inches.

19. The food cooking oven of claim 18 wherein said interior walls are stainless steel.

20. The food cooking apparatus of claim 15 wherein each of said clamps comprises a first clamping member and a rotatably mounted second clamping member.

21. The food cooking apparatus of claim 15 wherein at least one of said clamps is movably mounted on said frame.

22. The food cooking apparatus of claim 15 wherein each of said clamps extends upwardly from said frame and the portion of said electrical contact members which is disposed in said clamps is horizontally disposed.

* * * * *